United States Patent [19]

Clark

[11] 4,073,166

[45] Feb. 14, 1978

[54] MAGNETIC LOCK PICK

[76] Inventor: William H. Clark, 16521 Queenside Drive, Covina, Calif. 91722

[21] Appl. No.: 756,080

[22] Filed: Jan. 3, 1977

[51] Int. Cl.[2] ..... E05B 19/20

[52] U.S. Cl. ..... 70/394; 70/411; 70/413

[58] Field of Search ..... 70/276, 394, 411, 413; 33/174 F; 81/3 R

[56] References Cited

U.S. PATENT DOCUMENTS

| | | | |
|---|---|---|---|
| 3,873,892 | 3/1975 | Dettling | 70/411 |
| 3,955,388 | 5/1976 | Stackhouse | 70/411 |

*Primary Examiner*—Robert L. Wolfe
*Attorney, Agent, or Firm*—Boniard I. Brown

[57] ABSTRACT

A device for opening locks with magnetically actuated tumblers or pins is provided with a housing of non-magnetizable composition and a plurality of interlocking gear wheels, pivotably retained in the housing, and also constructed from materials not susceptible to permanent magnetization. The gear wheels are pierced by a plurality of orifices across their thickness and cylindrical permanent magnets are inset into each orifice with a substantially random distribution of their North and South poles with respect to the faces of the wheels. Means are provided to rotate the wheels simultaneously around their pivot axes, thereby generating a changing, random distribution of magnetic fields arising from the interaction of the inset permanent magnets. By holding the housing of the magnetic pick proximate to the usual placement of the coded magnet key of the lock, the magnetic pins, or tumblers, therein are exposed to a large combination of structured magnetic fields, one of which is likely to correspond to the key code.

10 Claims, 7 Drawing Figures

12
14
70
5
100
N
S
60
17
7
16
10
18

70
12b
20

100
61
60
65
12a 14a
60
100
70
61
17
18
14b
12a
16
20
62
12b 110
112
114
70
60
16
17

MAGNETIC LOCK PICK

BACKGROUND OF THE INVENTION

1. Field of the Invention

The invention relates to lock picks for padlocks, and their like, equipped with magnetically actuated pins or tumblers. It relates, more particularly, to lock picks which generate a randomly coded magnetic field by the simultaneous rotation of a number of wheels with interlocking gear teeth, with each wheel carrying a plurality of permanent magnets.

2. Discussion of the Prior Art

The art of making locks, padlocks and other devices for preventing unauthorized access to places and things is old. The companion art of making lock picks is almost as old, and aims at providing means to gain access without the requisite key to operate the lock.

Until the recent introduction of magnetically coded "keys", usually in the form of a plastic card or bar with imbedded permanent magnets to create a field with a specified strength and orientation, all lock picks were themselves mechanical and were designed to move the tumblers, pins, levers and other forms of locking members into the proper alignment so that the lock could be opened. With the advent of magnetic locks a need arose for devices which could create the required fields without any prior knowledge of the field coded into the magnetic key. Locksmiths called upon to open locks to which keys have been lost, law enforcement and emergency service officers and others have a need for such magnetic lock picks. No device had yet appeared in the art which would answer to the need.

It is, therefore, a primary object of the invention to provide a device for opening locks designed to respond to magnetically coded keys.

It is a further object of the invention to provide a lock pick for magnetic locks and padlocks which is capable of creating a spatially varying field in a random manner and to alter rapidly the random field in a search for the correct combination.

It is yet another object of the invention to provide a magnetic lock pick which is simple to manufacture, easy to use, and readily adapted to locks of different sizes and shapes.

SUMMARY OF THE INVENTION

The above objects, and other objects and advantages which shall become apparent from the detailed description of the preferred embodiment thereof below, are attained in a device based on a plurality, commonly two or three, of flat, round disks of a non-magnetic material whose peripheries are formed into geared wheels. The aforementioned disks are mounted in a housing, whose material provides no magnetic shielding effect, on central pivots in linear alignment, with the peripheral teeth of adjacent disks in engagement.

Each of the disks is pierced, across the thickness, by a number of circular orifices in regular or random arrays with respect to radial and angular location. A small permanent magnet of cylindrical section is inserted into each of the orifices with their magnetic axes aligned but with their poles in substantially random locations; so that viewing either face of a disk would present some North and some South poles to a viewer.

With the disks assembled into their housing a varying magnetic field is set up surrounding the external faces of the case. This field is substantially random in orientation and strength, being created by the vector addition of the field strengths and directions of each of the permanent magnets in the assembly. The rotation of any one wheel, transmitted to all the other wheels in the array by the interacting geared peripheries, creates a temporal variation in the random composition of the summed field, while movement of the casing with respect to a specific location will vary the field experienced at that location.

In use, the lock pick, more particularly some portion of the outer casing covering the wheel assembly, is brought into the proximity of the control components of the lock. In this manner the tumblers, pins or other movable parts within the lock are exposed to the random field of the lock pick and take up positions governed by their specific magnetic susceptibility. Since it is unlikely that any given position of the wheels will result in the appropriate field, corresponding to the field of the key for the specific lock, the wheels are then set into motion to vary the field experienced by the lock.

As the wheels are rotated, by means of a suitable control, manual or externally powered, the lock tumblers will move around correspondingly. At some point, the process may be aided by periodic changes in the location of the lock pick as a whole, the tumblers will assume the "open" command pattern and the lock will open. Experience with magnetic locks on the market would indicate that a period of 2 to 3 minutes is sufficient to achieve lock opening utilizing the lock pick of the invention.

The rotation of the disks is most readily attained by leaving a portion of the mounting case open in such a manner that the edge of one of the disks protrudes. In such an embodiment the toothed periphery of the disk can be used as a thumbwheel and the device "tuned" with the same hand in which it is held, a matter of some import if the other hand has to be used to support the lock, as may be the case with a padlock.

It is also possible to provide automatic drive means, by a wound spring motor, or by a small electric motor, battery or line powered, for greater convenience.

BRIEF DESCRIPTION OF THE DRAWINGS

The preferred embodiment of the invention will be described with reference to the illustrations of the accompanying drawings, in which.

DESCRIPTION OF THE PREFERRED EMBODIMENT

Figure 1:
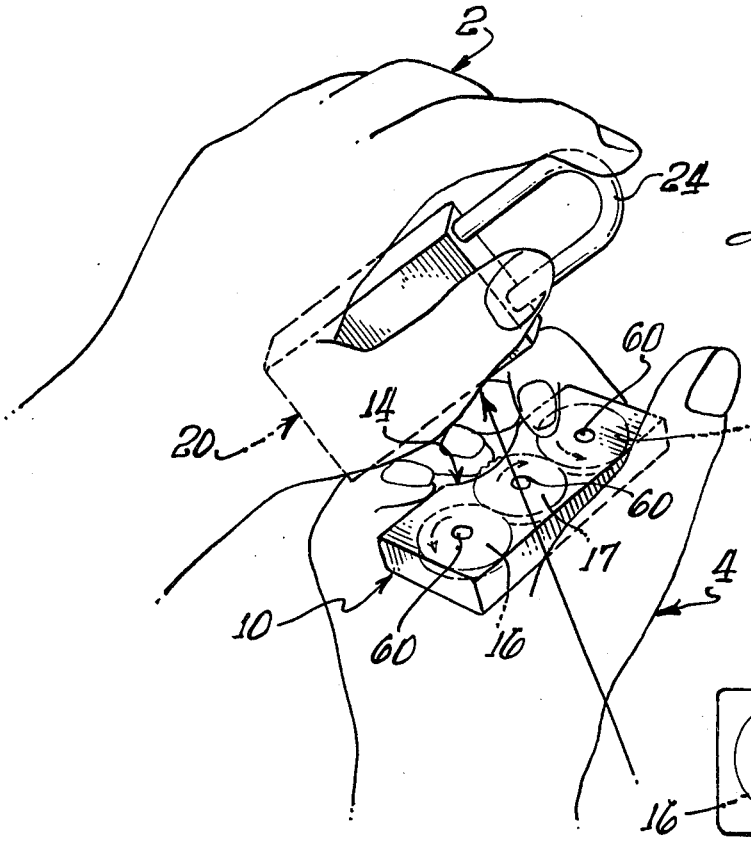
FIG. 1 is a perspective view of a magnetically actuated padlock and a magnetic lock pick of the invention being manipulated in the two hands of a user.

The perspective view of FIG. 1 shows a lock pick 10 of the invention in use, just prior to being brought into contact with the "key face" of a magnetically operated lock 20. The lock 20 is in the form of a common padlock and is held in the palm of left hand 2 of the user. The lock pick 10 is cradled in right hand 4 with its housing 12 encompassed by the thumb, index finger and little finger. The two central fingers of right hand 4 bear against the periphery of a central disk 17 within the lock pick, made accessible by a cutout 14 in the housing 12.

Figure 3:
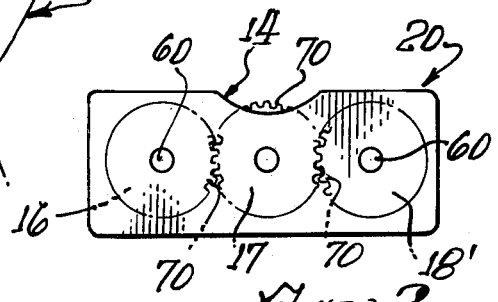
FIG. 3 is a view, in elevation, of the preferred embodiment of the invention, as also shown in FIG. 1.

As shown in the frontal view of FIG. 3, the housing 12 contains two disks, marked 16 and 18, on either side of the central disk 17. All three disks carry gear teeth on their peripheries and form a gear train, so that any rotation imparted to the central disk 17 by the fingers of the user induce the simultaneous rotation of the flanking disks 16 and 18.

The lock pick of the invention is intended for use with magnetically operated locks, as typified by the padlock 20, whose opening is accomplished by the imposition of a spatially structured magnetic field. The padlock 20, shown in the transverse, sectioned view of FIG. 2, accomplishes its locking function by means of a retained shackle 24 which is released by means of a magnetic key 120, also shown in FIG. 2.

The shackle 24 is retained at both ends, in the locked condition, in a housing 22. The shackle 24 has two legs, a longer leg 34, permanently retained within the housing in bearings integral therewith, and a shorter leg 44 which penetrates the housing 22 in the locked condition and is free of it in the unlocked condition. The inboard portion of the leg 34 is provided with a relief 26 which may be engaged by a pin 28.

The pin 28 is attached to a code bar 30 which is pierced by a number of orifices 40. Four such orifices are shown in the code bar of the illustrated padlock 20, but their number may vary from lock to lock and their spatial location will be different for locks of the same type, corresponding to different key combinations.

The conjoint assembly of the code bar 30 and the pin 28 is actuated by two springs, a saddle spring 32 and a rocker spring 36. The latter serves to move the pin 28 into the locked condition upon the depression of the shackle 24 into the housing 22. The saddle spring 32, on the other hand, urges the code bar assembly away from the leg 34 of the shackle, to attain the unlocked condition of the padlock 20.

The code bar 30 is prevented from moving by the presence of a number of swivel pins 42 whose inboard ends are shaped to mate with the orifices 40 and whose outboard ends carry permanent magnets 46. The swivel pins 42 are supported in pivot membrane 50 in such a manner that their inboard ends are free to reciprocate in a plane encompassing the orifices 40. Since the swivel pins are themselves inaccessible from the outside of the lock case 22, their pivotal movement may only be accomplished by the imposition of an external magnetic field acting on the magnets 46.

It is evident that the lock will open only if all four of the swivel pins 42 can be brought, simultaneously, into an alignment of their inboard ends with the orifices 40, and that to achieve this state the intensity and direction of the external magnetic field must be structured in a particular pattern. It is the function of the magnetic key 120 to establish the properly coded magnetic field; this being accomplished by the insertion of a number of permanent magnets 146 into the non-magnetic body, conventionally of molded plastic, of the key.

Figure 2:
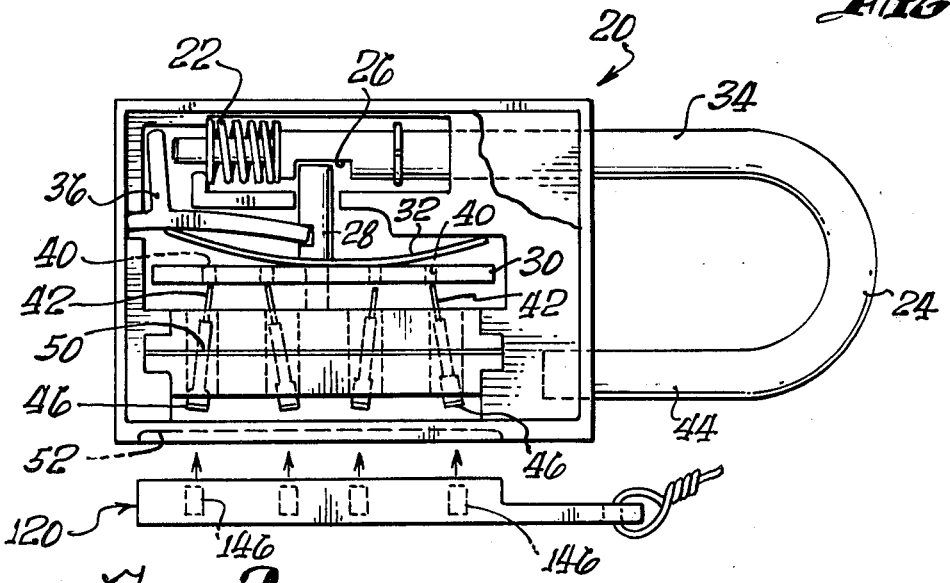
FIG. 2. PRIOR ART
FIG. 2 is a transverse section through a typical magnetically operated padlock of the art, and of a magnetic key supplied for the opening thereof.

In the simplest form, the one shown in FIG. 2, the embedded magnets 146 of the key correspond in number to the number of swivel pins 42 and the magnets 146 are aligned with the positions of the magnets 46 inside the lock with their magnetic poles in direct opposition to those on the pins 42. In this structure as soon as the key 120 is brought into proper alignment with the internals of the lock 20, aided by the provision of a relief 52 in the housing 22 whose dimensions allow the key 120 to be inserted thereinto, the magnets 46 are swung into closest possible alignment with the magnets 146 under the influence of the magnetic attractive forces created by the interacting fields.

As soon as this geometric alignment is attained the code bar 30 becomes free to slide over the pins 42, moved by the force of the saddle spring 32, and pulls the pin 28 out of the relief 26 in the shackle. A small spring 22, coaxial with the leg 34 of the shackle 24 causes the latter to move outwardly from the body 22 and to release the shackle leg 44. At the end of this process the lock is open and the removal of the key 120 from the relief 52 will not result in relocking it. To relock the padlock 20 the shackle has to be reinserted into the body 22 and then pressed down to cause the rocker 36 to pull the pin 28 back into the pocket 26 in the shackle.

The lock pick 10 is intended to secure the opening of the lock 20, or its analogues, by creating a randomly structured, variable magnetic field which, at some relative position of the lock pick with respect to the lock and at some specific angular rotation of the magnetic disks therewithin, will correspond to the field of the key 120, or its equivalent.

Figure 4:
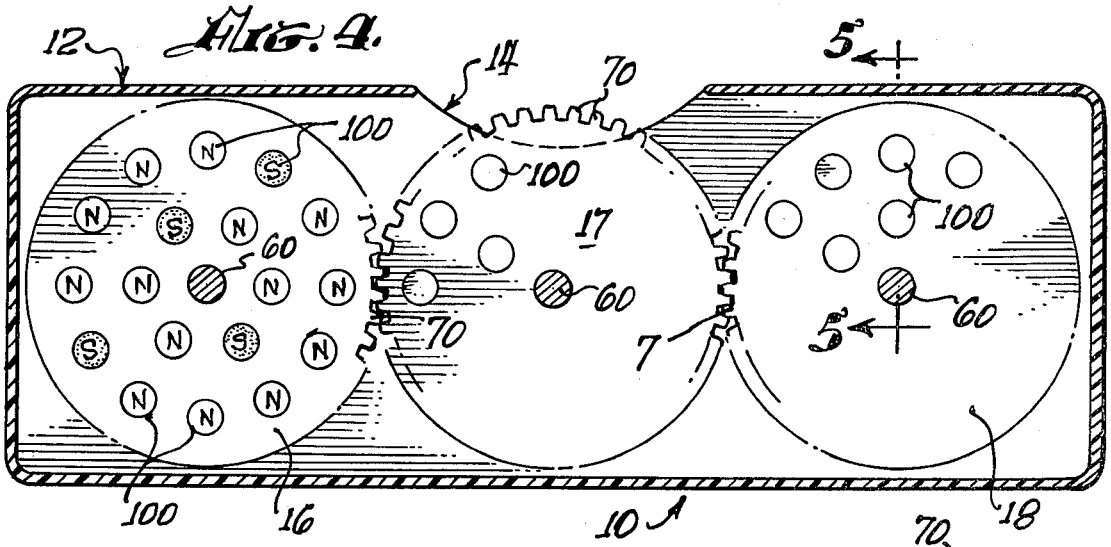
FIG. 4 is a sectioned view of the embodiment of FIG. 3, showing the internal components of the magnetic lock pick.
Figure 5:
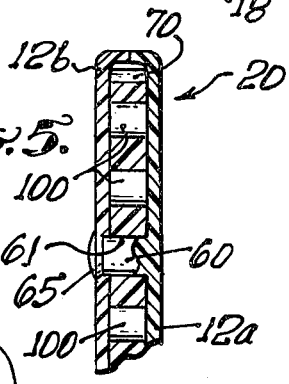
FIG. 5 is a lateral section through the magnetic lock pick, taken along section line 5—5 in FIG. 4.
Figure 6:
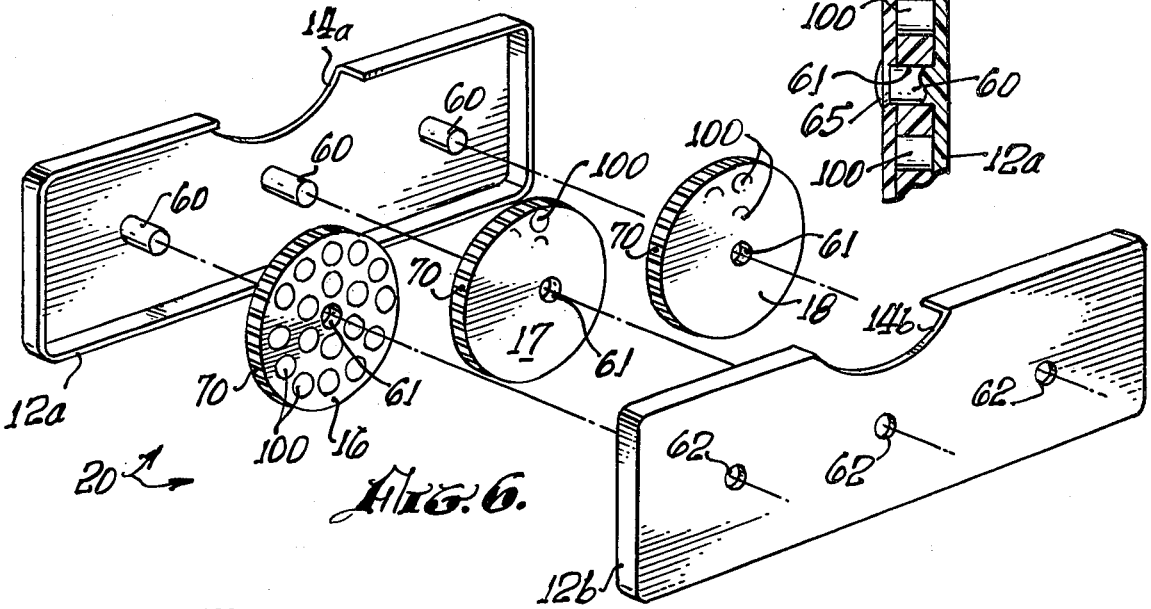
FIG. 6 is an exploded view of the embodiment shown in FIGS. 1, 3, 4 and 5, showing with particular clarity the arrangement of the three magnetic code wheels therein and the provision of integral pivot pins with one-half of the casing.
Figure 7:
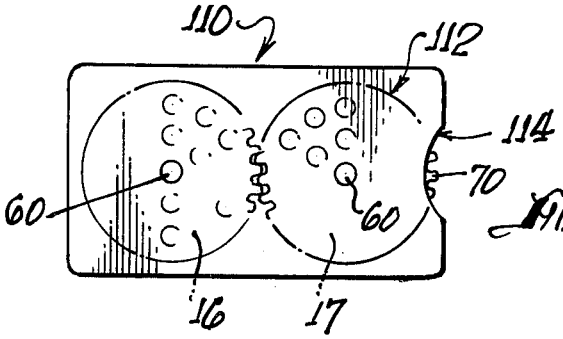
FIG. 7 is an elevational view of an alternate embodiment of the invention, using two code wheels, with the internal components shown in phantom outlines.

The internal structure of the preferred embodiment of the lock pick of the invention is shown in FIGS. 4, 5 and 6; an alternate embodiment is illustrated in FIG. 7.

The magnetic lock pick of the invention creates the structured magnetic field required for the opening of magnetic locks by providing a number of disks of circular outline, provided with a central bearing and a large number of permanent magnets inset into orifices parallel to the bearing orifice.

Turning to the transverse, sectioned view of FIG. 4, we see a central disk 17, flanked by disks 16 and 18, in mutual engagement by means of gear teeth 70 continuous around the periphery of each, with each of the disks 16, 17 and 18 freely rotatable on shafts 60 affixed in the casing 12 of the lock pick 10. Each of the disks is drilled through its thickness by a large number of cylindrical orifices, into each one of which a cylindrical permanent magnet 100 is pressed. The orifices may be drilled into the disks in a regular or a random pattern, the former being preferable for ease of manufacture, and the magnets are placed into the orifices in a completely random pattern so that their North and South poles alternate randomly on either face of each disk. A portion of the periphery of the central disk 17 is made accessible by a cutout 14 in the case 12, so that the geared edge 77 of the disk may be used as a thumbwheel to secure rotation of the disk 17, and the consequent rotation of disks 16 and 18.

Given any angular position of the disks 16, 17 and 18, the magnetic fields of the magnets 100 may be summed along any plane radiating from the case 12 to provide a pattern of field strength and polarity which is unique to that plane. In each plane the resulting field structure will be different. Any small rotation of the central disk 17 will lead to a realignment of all the magnets 100 within the case, thereby generating an entirely new set of magnetic fields around the lock pick 10. Therefore, any relative movement of the casing 12, and any rotation of the disk 17, will generate a different key code when the lock pick 10 is held in the proximity of the internal magnets of a magnetically operated lock or padlock. In this manner, given the large number of interacting magnets, an essentially infinite set of structured magnetic fields can be readily generated, one member of which is likely to be equivalent to the field of the key appropriate to the lock being opened. Experience with sample locks and picks indicates that a time expenditure of two to three minutes will result in success; success being defined as the attainment of an open lock or padlock.

In the preferred embodiment of the lock pick 10 the case 12 is comprised of symmetrical molded housing halves 12*a* and 12*b*. Molded plastic allows for ease of manufacture and provides the required non-magnetic enclosure. Substitution of other enclosures, made of wood, aluminum or brass, for example, is possible but plastic is preferred for its relatively low cost, lightness and the total absence of any shielding effect.

The casing half 12*a* bears a set of equispaced shaft members 60 to be engaged by the bearing orifices 61 in the magnet code disks; the mating housing half 12*b* is provided with orifices 62 to retain the ends of the shafts 60. Upsetting the ends of the shafts 60 into heads 65 is the preferred method of completing the assembly of the several component parts of the lock pick 10, shown in the exploded view of FIG. 6, as illustrated in the fragmentary section of FIG. 5.

The view of FIG. 7 shows an alternate embodiment 110 of the lock pick, with the magnetic code disks 16 and 17 enclosed on a housing 112. The peripheral teeth 70 of the disk 17 being made accessible for rotational actuation by the presence of a cutout 114 in the case 110. The use of only two magnet-bearing disks restricts the complexity of the magnetic field produced, so that relatively longer periods of manipulation are required, on the average, to attain the desired key code. This operational disadvantage is offset by the lighter weight, smaller size and ease of manipulation offered by the lock pick 110, as opposed to embodiments with more complex code wheel structures.

The magnetic lock pick of the invention was described above with reference to its preferred embodiment in which a plurality of magnetic code disks, comprised of a matrix of non-magnetizable material inset with a plurality of permanent magnet bodies, are rotatably, and in mutually entraining engagement, enclosed in a housing of a non-magnetic material, with the housing so structured that access to at least one of the code disks is provided, to allow for manual rotation of the disk train.

A person skilled in the art, upon exposure to the teachings herein, may come to contemplate changes in the mechanical arrangement and operation of the constituent parts. Such variants are deemed to be encompassed by the invention, delimited only by the appended claims. The aforementioned changes, substitutions and developments may include, but not be restricted to, the following:

The use of magnetic code disks of differing diameters, so that successive revolutions of a given code disk will give rise to differing magnetic fields;

The provision of external drive means, such as spring motors and electric motors, battery or line powered, in place of the manual rotation of the code disk train;

The substitution of code disks in which a plurality of randomly magnetized domains are embedded, such as a dispersion of ferritic magnets in a plastic matrix;

The substitution of a magnetic coating, randomly magnetized, on the surface of the code disks for the discrete magnetic bodies inset or embedded thereinto; and The use of friction grip means, serrated edges, elastomeric surfaces or coatings, instead of the formal gear teeth, at the periphery of the disks.

The inventor claims:

1. A lock pick for opening magnetically operated locks and their like, comprising:

an enclosure, constructed of a non-magnetizable material;

a plurality of code disks of non-magnetic material, rotatably housed within said enclosure, with their rotational axes in parallel alignment and the peripheries of adjoining code disks in mutually entraining relationship;

randomly oriented magnetized domains within said code disks; and drive means for entraining said code disks into simultaneous rotation, whereby a randomly structured, varying magnetic field is created external to said enclosure.

2. The lock pick of claim 1, wherein said plurality of code disks numbers two.

3. The lock pick of claim 1, wherein said plurality of code disks numbers three.

4. The lock pick of claim 1, wherein the peripheries of said adjoining code disks are formed into mating gear wheels.

5. The lock pick of claim 1, wherein said randomly oriented magnetic domains comprise a plurality of permanent magnets inset into the matrix of each of said code disks.

6. The lock pick of claim 1, wherein said drive means include a cutout in the sheath of said enclosure, providing access to the periphery of one of said code disks, for the manual rotational actuation thereof.

7. The lock pick of claim 4, wherein said rotational axes are in lineal alignment and equally spaced from one another, and wherein said code disks are made with identical pitch diameters, equal to said spacing of the rotational axes.

8. The lock pick of claim 7, wherein said rotational axes are defined by shafts integral with one portion of said enclosure.

9. The lock pick of claim 1, wherein said nonmagnetic material is a plastic composition.

10. The lock pick of claim 5, wherein said permanent magnets are cylindrical in form and pass through the thickness of said code disks in cylindrical orifices parallel to said axes of rotation.

* * * * *